US009645520B2

(12) United States Patent
Hirata et al.

(10) Patent No.: US 9,645,520 B2
(45) Date of Patent: May 9, 2017

(54) OPTICAL WRITING DEVICE, IMAGE FORMING DEVICE, OPTICAL WRITING CONTROL METHOD, AND COMPUTER PROGRAM PRODUCT

(71) Applicants: Satoshi Hirata, Kanagawa (JP); Yuuya Ogawa, Kanagawa (JP); Atsushi Yamazaki, Kanagawa (JP); Hiroyuki Yanagi, Kanagawa (JP)

(72) Inventors: Satoshi Hirata, Kanagawa (JP); Yuuya Ogawa, Kanagawa (JP); Atsushi Yamazaki, Kanagawa (JP); Hiroyuki Yanagi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 6 days.

(21) Appl. No.: 14/643,345

(22) Filed: Mar. 10, 2015

(65) Prior Publication Data

US 2015/0268580 A1 Sep. 24, 2015

(30) Foreign Application Priority Data

Mar. 18, 2014 (JP) ..... 2014-055677

(51) Int. Cl.
*G03G 15/043* (2006.01)
*B41J 2/435* (2006.01)
*B41J 2/44* (2006.01)

(52) U.S. Cl.
CPC ..... *G03G 15/043* (2013.01)

(58) Field of Classification Search
CPC ..... G03G 15/04; G03G 15/04027; G03G 15/043; B41J 2/44; B41J 2/447; B41J 2/45; B41J 2/465; B41J 2/4655; B41J 2/47
See application file for complete search history.

(56) References Cited

U.S. PATENT DOCUMENTS 5,136,316 A * 8/1992 Punater ..... G03G 15/065 347/130
2005/0117133 A1 6/2005 Ishikawa
2006/0044386 A1 3/2006 Ishikawa
2006/0109491 A1* 5/2006 Naito ..... G03G 15/043 358/1.13

(Continued)

FOREIGN PATENT DOCUMENTS

JP 2003-271016 9/2003
JP 2004-219929 8/2004

*Primary Examiner* — Geoffrey Mruk
*Assistant Examiner* — Scott A Richmond
(74) *Attorney, Agent, or Firm* — Oblon, McClelland, Maier & Neustadt, L.L.P.

(57) ABSTRACT

An optical writing device writes an image on a photoconductor with light emitted from a light-emitting element array including a plurality of light-emitting elements lined in one direction. The optical writing device includes: a thinning unit that thins pixels in input binary image data depending on a pattern of the image data; a thinning rate setting unit that sets a thinning rate by the thinning unit for each predetermined range of the image data; and a light-emitting time changing unit that changes a light-emitting time of the light-emitting element array for each predetermined range of the binary image data thinned by the thinning unit depending on the thinning rate set by the thinning rate setting unit and a set toner saving rate.

14 Claims, 11 Drawing Sheets

(56) References Cited

U.S. PATENT DOCUMENTS

| | | | |
|---|---|---|---|
| 2006/0181595 | A1 | 8/2006 | Ishikawa |
| 2007/0013925 | A1 | 1/2007 | Ishikawa |
| 2011/0043595 | A1 | 2/2011 | Ishikawa |

* cited by examiner

METHOD FOR SETTING LIGHT-EMITTING TIME 600 dpi 1 BY 1

600 dpi 1200 dpi (a) NO TONER SAVING 600 dpi 1200 dpi (b) TONER SAVING 50%

OPTICAL WRITING DEVICE, IMAGE FORMING DEVICE, OPTICAL WRITING CONTROL METHOD, AND COMPUTER PROGRAM PRODUCT

CROSS-REFERENCE TO RELATED APPLICATIONS

The present application claims priority to and incorporates by reference the entire contents of Japanese Patent Application No. 2014-055677 filed in Japan on Mar. 18, 2014.

BACKGROUND OF THE INVENTION

1. Field of the Invention

The present invention relates to an optical writing device that writes an image, an image forming device that includes the optical writing device, an optical writing control method thereof, and a computer program product.

2. Description of the Related Art

In electrophotographic image forming devices such as digital copiers and printers, there has been used a technique that performs mask processing on pixels of image data to thin the pixels by converting black pixels into white pixels, as one of the toner saving functions for reducing toner consumption.

When a toner saving mode is set, it has been known that continuity is determined between target pixels and peripheral pixels in an array consisting of a plurality of low-resolution image data and the printing pixels are reduced based on the determination result of the continuity in order to reduce printing pixels. This technique can reduce the consumption of toner without deteriorating print quality.

In view of the foregoing, there is a need to prevent image quality from being deteriorated and to reduce output of an unintended hatching image even when image data is thinned and written.

SUMMARY OF THE INVENTION

It is an object of the present invention to at least partially solve the problems in the conventional technology.

An optical writing device writes an image on a photoconductor with light emitted from a light-emitting element array including a plurality of light-emitting elements lined in one direction. The optical writing device includes: a thinning unit that thins pixels in input binary image data depending on a pattern of the image data; a thinning rate setting unit that sets a thinning rate by the thinning unit for each predetermined range of the image data; and a light-emitting time changing unit that changes a light-emitting time of the light-emitting element array for each predetermined range of the binary image data thinned by the thinning unit depending on the thinning rate set by the thinning rate setting unit and a set toner saving rate.

An optical writing control method writes an image on a photoconductor with light emitted from a light-emitting element array including a plurality of light-emitting elements lined in one direction. The optical writing control method includes: thinning pixels in input binary image data depending on a pattern of the image data; setting a thinning rate at the thinning for each predetermined range of the image data; and changing a light-emitting time of the light-emitting element array for each predetermined range of the binary image data thinned at the thinning depending on the thinning rate set at the setting and a set toner saving rate.

A computer program product includes a non-transitory computer-readable medium containing an information processing program. The program causes a computer in a device that writes an image on a photoconductor with light emitted from a light-emitting element array including a plurality of light-emitting elements lined in one direction to perform: thinning pixels in input binary image data depending on a pattern of the image data; setting a thinning rate at the thinning for each predetermined range of the image data; and changing a light-emitting time of the light-emitting element array for each predetermined range of the binary image data thinned at the thinning depending on the thinning rate set at the setting and a set toner saving rate.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments for performing the present invention are described in detail below with reference to the accompanying drawings.

Figure 1:
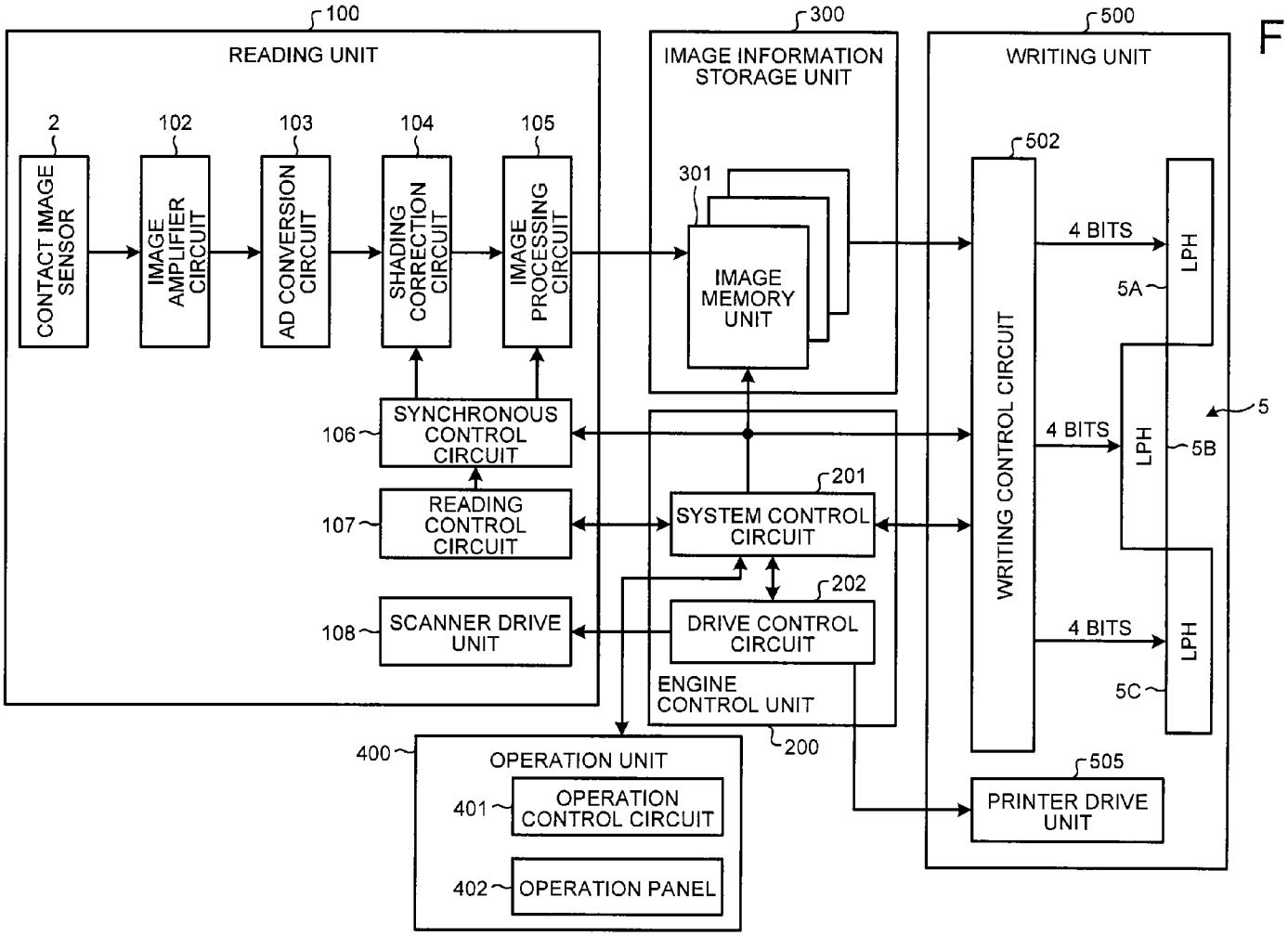
FIG. 1 is a block diagram illustrating a schematic configuration of an image forming device that includes an optical writing device according to an embodiment of the present invention.
Figure 2:
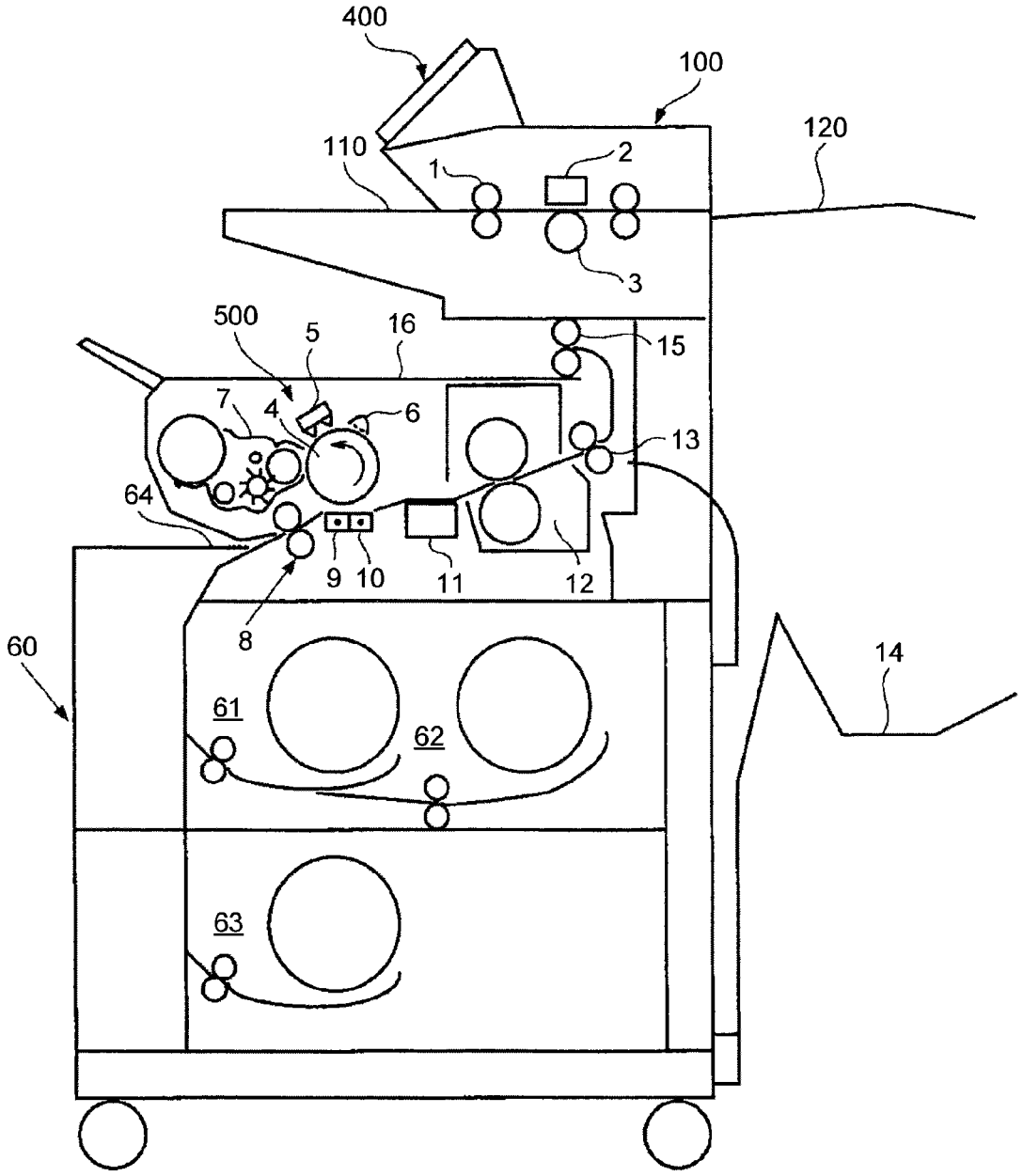
FIG. 2 is a schematic diagram illustrating a configuration example of mechanical units in the image forming device.

A description will be made of a configuration of an image forming device that includes an optical writing device according to an embodiment of the present invention. FIG. 1 is a block diagram illustrating a schematic configuration of the image forming device, and FIG. 2 is a schematic diagram illustrating a configuration example of mechanical units in the image forming device. The image forming device in this embodiment is a digital copier.

This image forming device includes, as illustrated in FIG. 1, a reading unit 100 serving as a reading unit for reading a document, an image information storage unit 300 serving as a storage unit for storing therein image information on the read document, and a writing unit 500 for copying the stored image information onto transfer paper. The image forming device also includes an engine control unit 200 for executing and controlling a series of processes and an operation unit 400 serving as an operation unit for performing key input and/or the like on this engine control unit 200.

The reading unit 100 includes a contact image sensor 2, an image amplifier circuit 102, an analog-to-digital (AD) conversion circuit 103, a shading correction circuit 104, an image processing circuit 105, a synchronous control circuit 106, a reading control circuit 107, and a scanner drive unit 108.

The engine control unit 200 includes a system control circuit 201 and a drive control circuit 202.

The image information storage unit 300 includes a plurality of image memory units 301.

The operation unit 400 includes an operation control circuit 401 and an operation panel 402, and the operation panel 402 includes a liquid crystal display panel and various kinds of input keys.

The writing unit 500 includes a writing control circuit 502, a line print head (LPH) 5, and a printer drive unit 505. The writing control circuit 502 will be described in detail later with reference to FIG. 3. The printer drive unit 505 is a mechanical unit for forming an image that will be described later with reference to FIG. 2. The writing unit 500 is the optical writing device according to the embodiment of the present invention.

The LPH 5 is a light-emitting element array including a plurality of light-emitting elements lined in one direction, and the LPH 5 for one line is composed of connecting three LPHs 5A, 5B, and 5C in a zigzag form in this embodiment. Each of the LPHs 5A, 5B, and 5C is constructed by combining a light-emitting diode (LED) array that includes light-emitting diodes (LEDs) arranged in one direction as light-emitting elements with a self-converging rod lens array, but other light-emitting elements such as organic electroluminescent (EL) elements may be used as light-emitting elements.

The system control circuit 201 in the engine control unit 200 has a function of controlling the whole image forming device, and controls image data transfer and the like in the reading control circuit 107, the synchronous control circuit 106, the image memory units 301, the operation unit 400, and the writing control circuit 502. The drive control circuit 202 is also controlled by the system control circuit 201, drives each motor and the like of the scanner drive unit 108 and the printer drive unit 505, and causes each unit illustrated in FIG. 2 to operate so as to smoothly control a series of processes of conveying a document to be read and transferring paper and forming an image.

A description will be made of the reading unit 100 with reference to FIGS. 1 and 2.

When inserted from a document insertion port 110 illustrated in FIG. 2 by an operator, a document is conveyed through a space between the contact image sensor 2 and a white roller 3 by rotation of a conveying roller 1. A light-emitting diode (LED) attached to the contact image sensor 2 irradiates the document being conveyed with light. Accordingly, reflected light corresponding to a document image is caused to form an image on the contact image sensor 2 so as to read image information. The document having image information read is sent out on a document receiver 120.

The document image formed on the contact image sensor 2 is converted into an electrical signal, and an analog image signal thereof is amplified by the image amplifier circuit 102 illustrated in FIG. 1. The AD conversion circuit 103 converts the analog image signal amplified by the image amplifier circuit 102 into a multivalued digital image signal for each pixel.

The converted digital image signal is taken into the shading correction circuit 104 in synchronization with a clock output from the synchronous control circuit 106, and distortion due to light quantity unevenness, dirt on a contact glass, sensitivity unevenness of a sensor and the like is corrected.

The corrected digital image signal is converted into digital image information for recording by the image processing circuit 105, and the digital image information is written into the image memory units 301 in the image information storage unit 300.

The reading control circuit 107 is controlled by the system control circuit 201 in the engine control unit 200, and controls the operation of the synchronous control circuit 106. The scanner drive unit 108 is controlled by the drive control circuit 202 in the engine control unit 200, and controls the operation of the mechanical units such as the conveying roller 1 illustrated in FIG. 2.

A description will be made of a function of the writing unit 500 (optical writing device according to the present invention) for forming an image on transfer paper with the digital image information written into the image memory units 301.

The writing unit 500 illustrated in FIG. 1 receives input of the digital image information from the image memory units 301. In a flow of the digital image information, one-pixel binary image data having a pixel density of 600 dpi is synchronized with a transfer reference clock and is transferred from the image memory units 301 to the writing control circuit 502 in parallel by two pixels. The writing control circuit 502 synthesizes the image information transferred in parallel by two pixels into one line therein, converts one pixel of 600 dpi into multivalued image data having four pixels of 1,200 dpi, divides the multivalued image data into three, assigns the divided image data to the LPHs 5A, 5B, and 5C, and transfers the data simultaneously by four pixels.

The system up to the image information storage unit 300 in FIG. 1 has been conventionally established, but a feature is present in the processing related to the toner saving executed in the writing control circuit 502 after the digital image information is written into the writing unit 500.

A description will be made of an image forming process executed by the mechanical units in the writing unit 500 in this image forming device with reference to FIG. 2.

The image forming device illustrated in FIG. 2 includes a photoconductor drum 4 rotating in a direction illustrated by an arrow in a main body, and includes a charging charger 6, the LPH 5, a developing unit 7, a transfer charger 9, and a separation charger 10 arranged around the photoconductor drum 4 in this order in the rotating direction. A pair of positioning rollers (referred to as a pair of registration rollers) 8 is provided at a predetermined position of a transfer paper conveyance passage at the upstream of the transfer charger 9. A conveying unit 11 and a fixing unit 12 are sequentially arranged downstream of the separation charger 10. The mechanical units in the writing unit 500 are composed of these.

The charging charger 6 is what is called a scorotron charger with a grid that uniformly charges the photoconductor surface on the outer periphery of the photoconductor drum 4. A charged voltage thereof is, for example, about −1,200 V.

The LPH 5 is a line print head of the above-mentioned light-emitting element array, and irradiates the charged photoconductor surface of the photoconductor drum 4 with light emitted from each of the LED elements through a self-converging rod lens.

When the charged photoconductor surface of the photoconductor drum 4 is irradiated with light from the LPH 5 based on the digital image information, charge of the irradiated part on the photoconductor surface flows to the ground of the photoconductor drum 4 due to the photoconductive phenomenon and then disappears.

If the LED elements are made not to emit light in a part having a low document density and are made to emit light in a part having a high document density, an electrostatic latent image according to the density of an image is formed on the photoconductor surface of the photoconductor drum 4. This electrostatic latent image is developed using toner in the developing unit 7. The toner in the developing unit 7 is negatively charged due to stirring, and adheres to only the light-irradiated part on the photoconductor surface. For example, a bias voltage of about −700 V is applied to a developing roller to which the toner in the developing unit 7 adheres.

Transfer paper is selected and fed from three roll paper feeding units 61 to 63 in a paper storage unit 60 and a manual paper feeding unit 64. The leading end of the transfer paper is pinched by the pair of positioning rollers 8, and the transfer paper is conveyed at a predetermined timing to a transfer position where the photoconductor drum 4 and the transfer charger 9 are opposed. When the transfer paper passes through the transfer position, the transfer charger 9 transfers a toner image on the surface of the photoconductor drum 4 onto the transfer paper.

The transfer paper is separated from the photoconductor drum 4 by the separation charger 10, conveyed by the conveying unit 11, and transferred to the fixing unit 12. The fixing unit 12 fixes the transferred toner image on the transfer paper. The transfer paper on which the toner image is fixed is ejected by a first paper ejection roller 13 to a recording paper receiver 14 outside the device or ejected by a second paper ejection roller 15 to a paper ejection tray 16 over the writing unit 500.

The configuration of the mechanical units in the writing unit 500 is one example, and any configuration may be adopted if the configuration includes an optical writing device that writes an image on a photoconductor with light emitted from a light-emitting element array.

The configuration may include a paper feeding unit storing therein sheet-like transfer paper, and may include a color image forming unit of a direct transfer system or an indirect transfer system.

Figure 3:
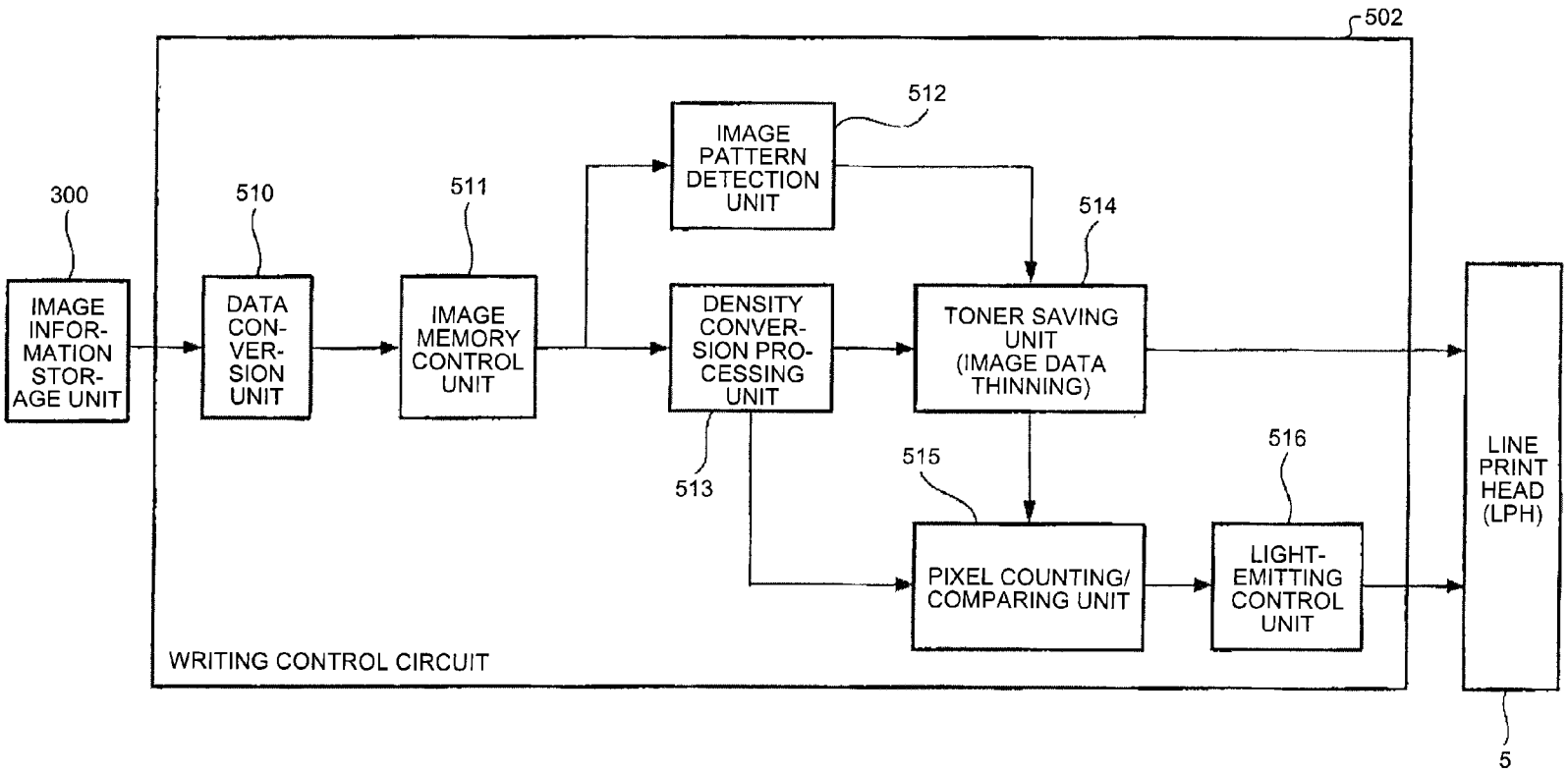
FIG. 3 is a block diagram illustrating a functional configuration example of a writing control circuit 502 in FIG. 1.

A description will be made of a function of the writing control circuit 502 in the writing unit 500 illustrated in FIG. 1 with reference to FIG. 3. FIG. 3 is a block diagram illustrating a functional configuration example of the writing control circuit 502.

A data conversion unit 510 receives the digital image information transferred from the image information storage unit 300, and converts the digital image information into image data.

An image memory control unit 511 rearranges the image data converted by the data conversion unit 510 for each line. An image pattern detection unit 512 and a density conversion processing unit 513 receive the image data of each line.

The image pattern detection unit 512 detects (identifies) an image pattern for the image data of each line based on the number of black-and white changing points with respect to the set window length.

The density conversion processing unit 513 performs image density conversion on the image data of each line. In this embodiment, the density conversion processing unit 513 performs four-time conversion on an input image of 300 dpi, three-time conversion on an input image of 400 dpi, and double conversion on an input image of 600 dpi. The description is omitted in this embodiment, but six-time density conversion may be performed on an input image of 200 dpi. This density conversion processing unit 513 is a unit that performs density conversion on image data.

Based on the result of the image pattern detected by the image pattern detection unit 512 and a set toner saving rate, a toner saving unit 514 sets a thinning pattern, in other words, a thinning rate, and performs thinning on the image data on which the density conversion processing unit 513 has performed density conversion.

The image pattern detection unit 512 and the toner saving unit 514 correspond to a thinning unit that thins pixels in the image data and a thinning rate setting unit that sets a thinning rate by the thinning unit for each predetermined range.

The image pattern detection unit 512 is an image pattern detecting unit, and the toner saving unit 514 sets different thinning rates (corresponding to the thinning amount) based on the kind of the pattern detected by the image pattern detection unit 512.

The window length for detecting a toner saving rate and an image pattern can be set and changed with the operation unit 400 illustrated in FIG. 1.

A pixel counting/comparing unit 515 counts and compares the number of pixels of the image data on which the density conversion processing unit 513 has performed image density conversion and the number of pixels of the image data thinned by the toner saving unit 514. The pixel counting/comparing unit 515 calculates an error with respect to the set toner saving rate for each line.

A light-emitting control unit 516 "determines the lower limit value of a light-emitting time" and "determines the upper limit value of a light-emitting time difference from the previous line" based on the result of the error calculated by the pixel counting/comparing unit 515 so as to calculate a light-emitting time. The pixel counting/comparing unit 515 can also calculate a light-emitting time.

The pixel counting/comparing unit 515 and the light-emitting control unit 516 correspond to a light-emitting time changing unit that changes the light-emitting time of the LPH 5, which is a light-emitting element array, for each predetermined range of the binary image data thinned by the thinning unit, depending on the thinning rate and the set toner saving rate.

The image data thinned by the toner saving unit 514 and a control signal of a light-emitting time calculated by the light-emitting control unit 516 are divided and transferred to the three LPHs 5A, 5B, and 5C forming the LPH 5.

Each of these functions is executed by a microcomputer provided to the writing control circuit 502 or a microcomputer in the system control circuit 201 illustrated in FIG. 1 by also serving as the microcomputer provided to the writing control circuit 502.

A description will be made of an example of a method for detecting an image pattern according to the present invention with reference to FIG. 4. This image pattern detection is executed by the image pattern detection unit 512.

Figure 12:
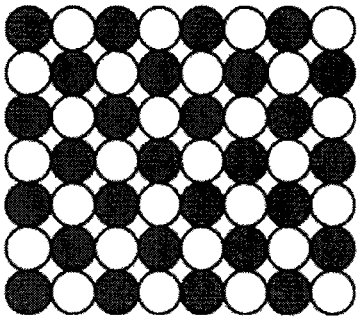
FIG. 12 is a diagram illustrating an example of image patterns for explaining a problem in a conventional toner saving technique.
Figure 12:
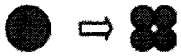
Figure 12:
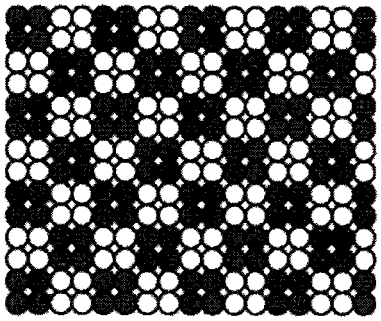
Figure 12:
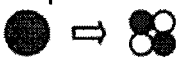
Figure 12:
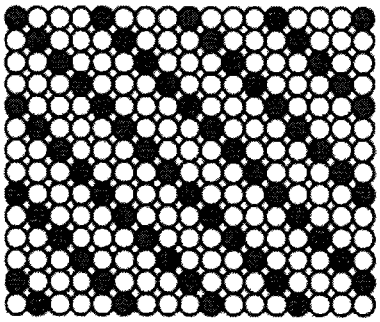

A halftone dot part indicates an image an image such as an image of 600 dpi illustrated in FIG. 12 that has many changing points in a predetermined range of image data.

Figure 4:
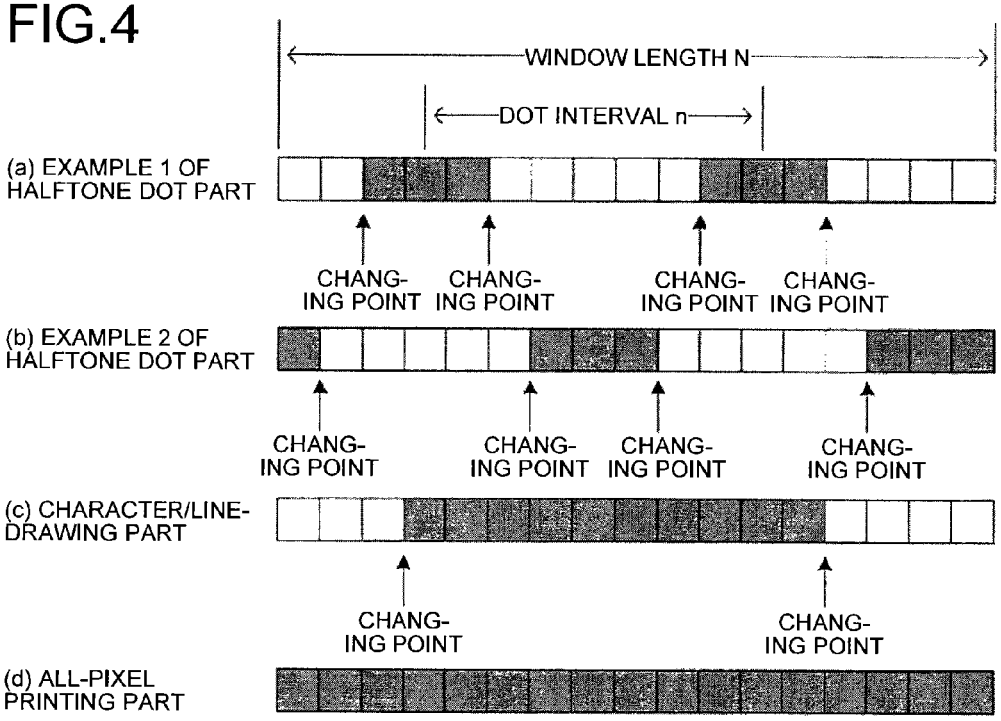
FIG. 4 is an explanatory diagram illustrating an example of a method for detecting an image pattern according to the embodiment of the present invention.

The sections (a), (b), (c), and (d) in FIG. 4 indicate an example 1 of the halftone dot part, an example 2 of the halftone dot part, an example of a character/line-drawing part, and an example of all-pixel printing part, respectively. The changing points in FIG. 4 represent points changed from black to white or from white to black. A dot interval n of the halftone dot part illustrated in the sections (a) and (b) is substantially constant, which means that the number of times where an image is changed from black to white or from white to black in a window frame of a window length N (the number of black-and-white changes) is substantially constant.

By contrast, the number of black-and-white changes in the character/line-drawing part illustrated in the section (c) is smaller than that in the halftone dot part, and the dot interval n thereof is not constant. The all-pixel printing part illustrated in the section (d) has no changing point because the whole part inside the window length N is printed. An image pattern is detected by detecting a difference in the number of black-and-white changes and the dot interval n in a window frame of the window length N.

The setting of the window length N specifying a range of image data where the number of black-and-white changes is detected may be changed as appropriate with the operation panel 402 in the operation unit 400 illustrated in FIG. 1. In this case, the operation unit 400 corresponds to a setting changing unit that changes the setting of a window length.

Figure 5:
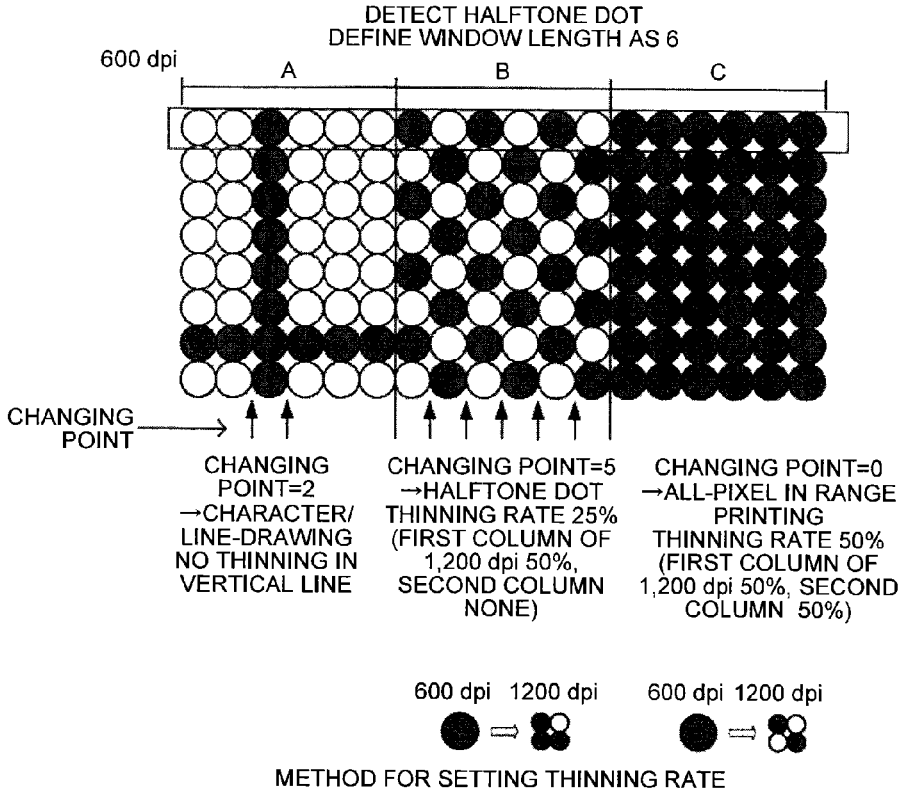
FIG. 5 is an explanatory diagram illustrating an example of a method for setting a thinning rate according to the present invention.

A description will be made of a method for setting a thinning rate with reference to FIG. 5. FIG. 5 is an example of double density conversion when the toner saving rate is set to 50% and the window length is set to 6.

In the uppermost line, a pattern A is determined to be characters/line-drawings because the pattern A has two changing points. A pattern B is determined to be halftone dots because the pattern B has five changing points. A pattern C is determined to be an all-pixel printing part because the pattern C has no changing point.

In the pattern A, no thinning is performed in a vertical line.

In the pattern B, the thinning rate is set to 25%, and in 1,200 dpi after double conversion, the printing rate is set to 50% in the first column and no thinning is performed in the second column (printing rate is 100%).

In the pattern C, the thinning rate is set to 50%, and in 1,200 dpi after double conversion, the printing rate is set to 50% in both the first and second columns.

The patterns B and C have different thinning rates. In the pattern C, a larger thinning rate is defined because all pixels are printed and thinning has little influence on the image. A print dot position setting in thinning in the case of double density from 600 dpi to 1,200 dpi may be freely changed.

Figure 6:
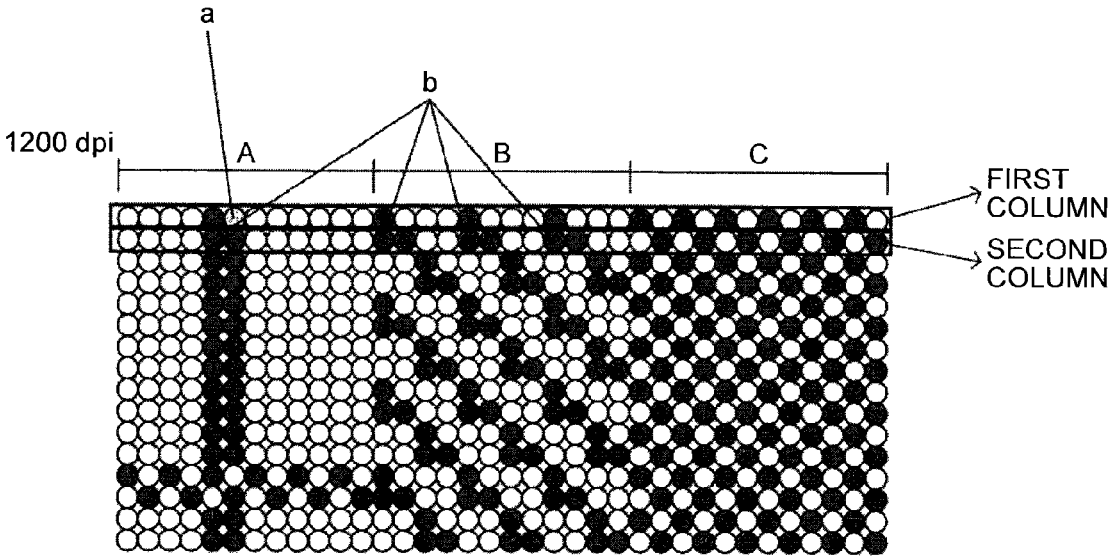
FIG. 6 is an explanatory diagram illustrating an example of a method for setting a light-emitting time according to the present invention.

A description will be made of a method for setting a light-emitting time with reference to FIG. 6. FIG. 6 is an explanatory diagram illustrating a method for setting a light-emitting time after a thinning rate is set in FIG. 5.

In the first column, the thinning rate is 45% and the printing rate is 55% due to eleven pixels printed after the conversion out of twenty pixels in 1,200 dpi conversion. As the pixel illustrated as a is printed, the toner saving rate fails to reach 50%. Therefore, the light-emitting time is adjusted as below.

Toner saving rate 50%/Printing rate 55%=Light-emitting time 90%

The toner saving rate of 50% is achieved by setting the light-emitting time to 90%.

In the second column, the thinning rate is 30% and the printing rate is 70% due to fourteen pixels printed after the conversion out of twenty pixels in 1,200 dpi conversion. As the pixels illustrated as b are printed, the toner saving rate fails to reach 50%. Therefore, the light-emitting time is set as below.

Toner saving rate 50%/Printing rate 70%=Light-emitting time 71%

The toner saving rate of 50% is achieved by setting the light-emitting time to 71%.

A description will be made of flows of control processing (processing procedure) when the writing control circuit 502 illustrated in FIG. 3 causes a microcomputer to execute the method for controlling a light-emitting time with reference to FIGS. 7 to 9. In these drawings, "Step" is abbreviated as "S". The processing in each step is executed by the microcomputer alone.

Figure 7:
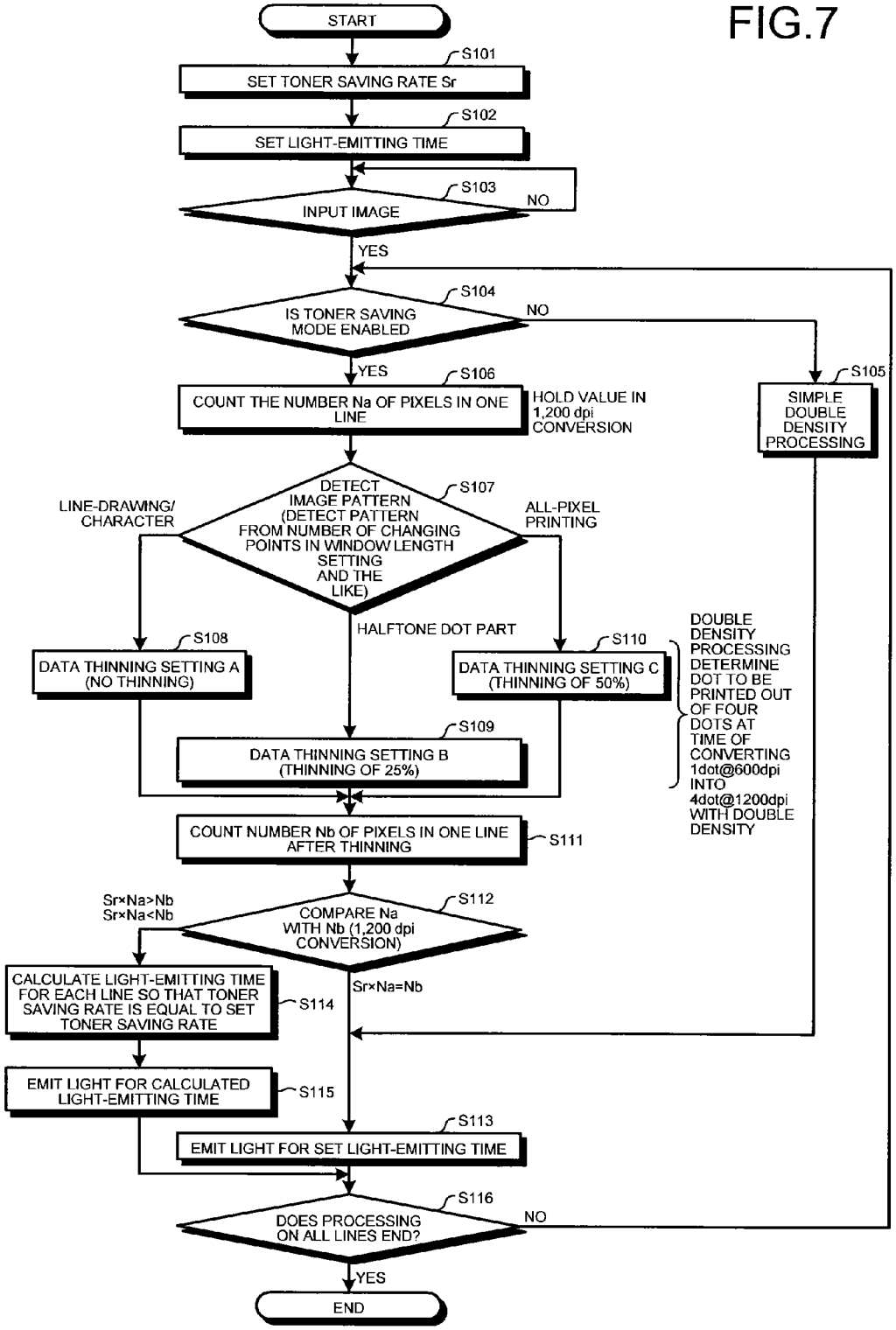
FIG. 7 is a flowchart illustrating the processing procedure of an optical writing control method according to a first embodiment of the present invention.

FIG. 7 is a flowchart illustrating the processing procedure of the optical writing control method according to the first embodiment of the present invention.

When this processing is started, a toner saving rate Sr is set at Step 101, and then a light-emitting time in the case of performing no thinning is set at Step 102.

It is confirmed whether an image is input at Step 103. If not, the microcomputer waits until the image is confirmed to be input. If the image is confirmed to be input, the process proceeds to Step 104.

It is determined whether a toner saving mode is enabled at Step 104. If "not", the process proceeds to Step 105. After simple double density processing is performed on the image data without thinning, the process proceeds to Step 113 and the LED elements in the LPH 5 are made to emit light for the set light-emitting time set at Step 102.

The simple double density means converting one pixel into n times the number of pixels, and the section (a) in FIG. 12 illustrates an example of doubled simple double density with no thinning control.

If a toner saving mode is determined to "be enabled" at Step 104, the process proceeds to Step 106 so as to count the number of pixels in one line and hold the value (Na) converted into 1,200 dpi.

Subsequently, an image pattern is detected at Step 107. In the image pattern detection, which of the following three patterns corresponds to an image pattern is determined by setting a window length with the number of dots on one line and considering the number of black-and-white changing points and a dot interval after crossing over two changing points.

When the number of changing points is a predetermined number or less and dot intervals are different, an image pattern is determined to be a "line-drawing/character".

When the number of changing points exceeds a predetermined number and dot intervals are almost uniformly repeated, an image pattern is determined to be a "halftone dot part".

When there is no changing point, an image pattern is determined to be "all-pixel printing".

If the "line-drawing/character" pattern is detected, the process proceeds to Step 108 so as to perform a data thinning setting A (no thinning). If the "halftone dot part" pattern is detected, the process proceeds to Step 109 so as to perform a data thinning setting B (thinning of 25%). If the "all-pixel printing" pattern is detected, the process proceeds to Step 110 so as to perform a data thinning setting C (thinning of 50%).

In any case, a thinning rate is set for each predetermined range of image data (in this case, one line) and a dot to be printed is determined out of four dots corresponding to one black pixel at the time of performing double density processing and converting one dot of 600 dpi into four dots of 1,200 dpi.

Subsequently, the process proceeds to Step 111 so as to count the number (Nb) of pixels in each line of the image data after double density processing and thinning. A comparison is made between the number Na of pixels in one line before thinning (1,200 dpi conversion) and the number Nb of pixels in one line after double density processing and thinning (1,200 dpi) at Step 112.

If the product of the toner saving rate Sr set at Step 101 and the number Na of pixels is equal to the number Nb of pixels, the process proceeds to Step 113 so as to make the LED elements in the LPH 5 emit light for the light-emitting time set at Step 102.

If the product of the toner saving rate Sr and the number Na of pixels is not equal to the number Nb of pixels, the process proceeds to Step 114 and the light-emitting time is calculated for each line so that a toner saving rate is equal to the toner saving rate Sr set at Step 101. The light-emitting time is calculated using a rate (percentage) to the light-emitting time set as illustrated in FIG. 6. The LED elements in the LPH 5 are made to emit light for the calculated light-emitting time at Step 115.

The process proceeds to Step 116 after the light emission at Step 113 or 115 so as to determine whether the processing on all lines ends. If not, the process returns to Step 104 so as to repeat the processing of each step on the next line. If the processing on all lines is determined to end at Step 116, the processing in FIG. 7 ends.

The method for controlling a light-emitting time according to the first embodiment can form an image satisfying a toner saving rate.

However, the whole image may be faded or an image that seems to be decolored in a stripe shape between lines may be formed because no lower limit value of a light-emitting time is defined in the first embodiment. When the amount of change in a light-emitting time from the previous line is large, the printing density is greatly changed and an image that seems to be decolored in a stripe shape may be formed.

A description will be made of a method for controlling a light-emitting time according to a second embodiment in which this point has been improved.

Figure 8:
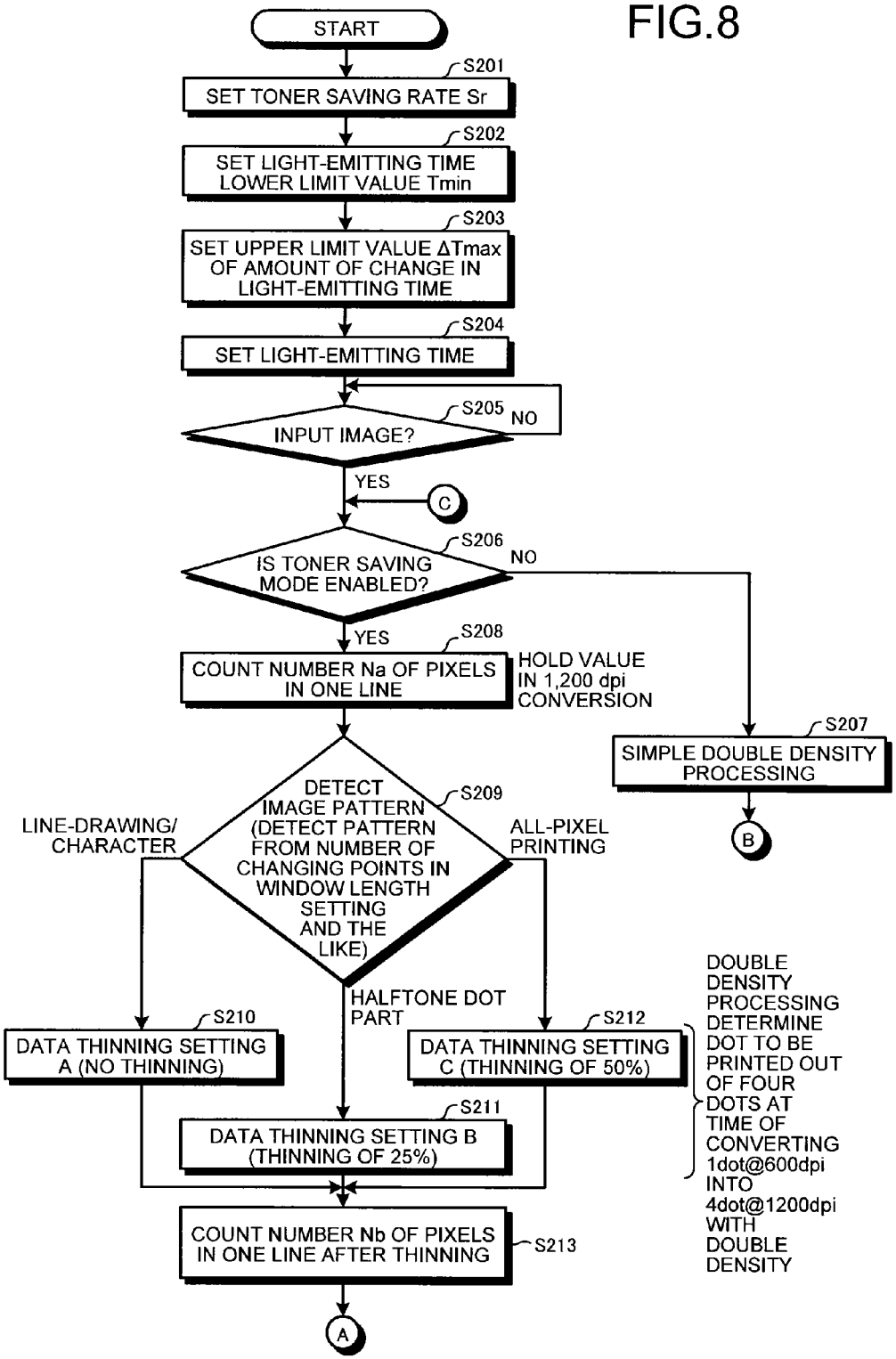
FIG. 8 is a flowchart illustrating the processing procedure of an optical writing control method according to a second embodiment of the present invention.
Figure 9:
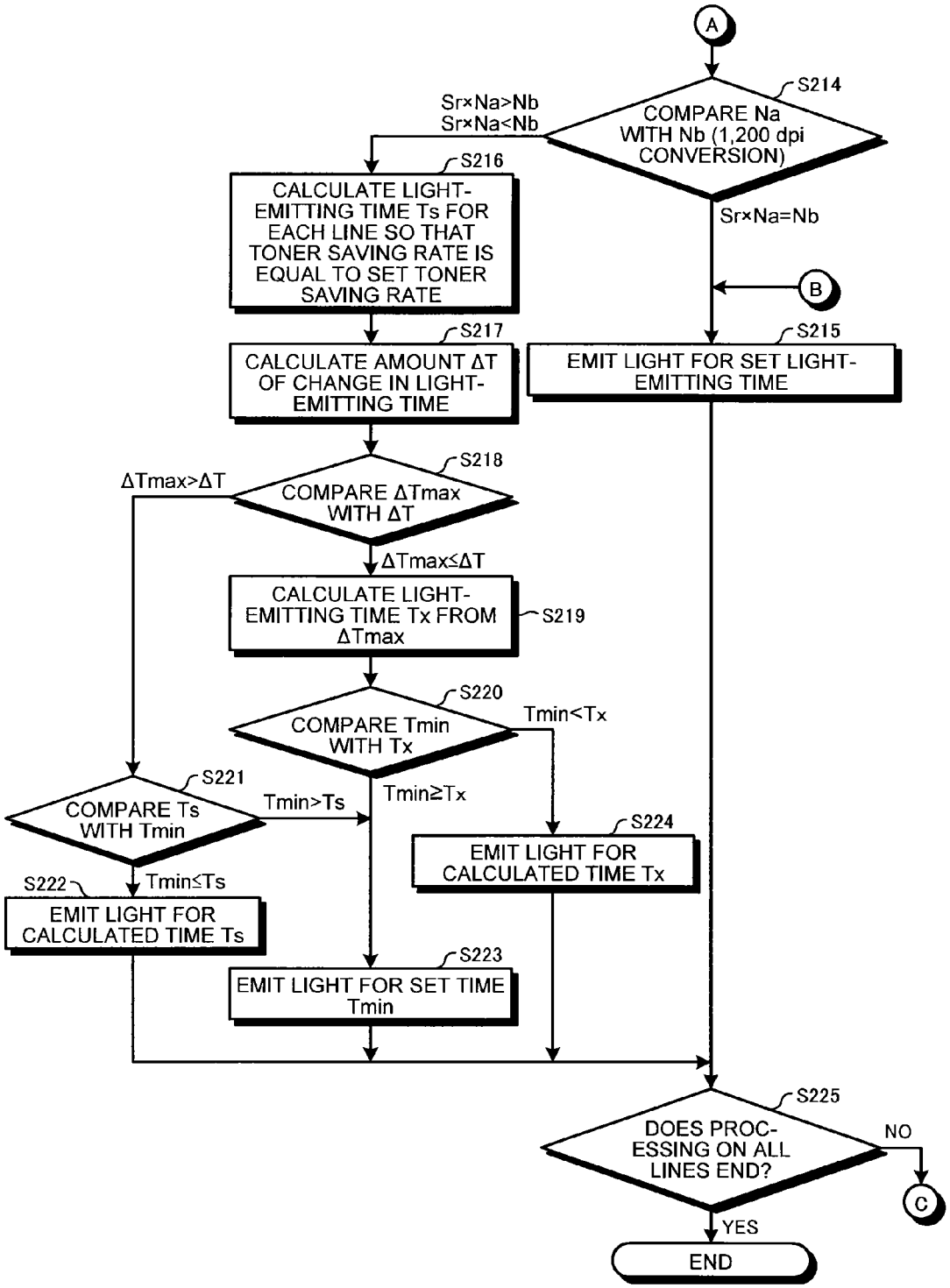
FIG. 9 is a flowchart subsequent to FIG. 8.

FIGS. 8 and 9 are flowcharts illustrating a flow (procedure) of processing when a microcomputer executes the control processing according to the second embodiment. FIGS. 8 and 9 are flowcharts illustrating a series of processing, but they are separately illustrated in two flowcharts for convenience of illustrations and flowlines are connected at the same terminal symbols of A, B, and C between two flowcharts.

When the control processing is started, the toner saving rate Sr is set at Step 201 in FIG. 8 and the lower limit value Tmin of a light-emitting time is set at Step 202. In addition, an upper limit value ΔTmax of the amount of change in a light-emitting time between lines is set at Step 203, and a light-emitting time in the case of performing no thinning is set at Step 204.

It is confirmed whether an image is input at Step 205. If not, the microcomputer waits until the image is confirmed to be input. If the image is confirmed to be input, the process proceeds to Step 206.

It is determined whether a toner saving mode is enabled at Step 206. If "not", the process proceeds to Step 207. After simple double density processing is performed on the image data without thinning at Step 207, the process proceeds to Step 215 in FIG. 9 and the LED elements in the LPH 5 are made to emit light for the set light-emitting time set at Step 204.

If a toner saving mode is determined to "be enabled" at Step 206, the process proceeds to Step 208 so as to count the number of pixels in one line and hold the value (Na) converted into 1,200 dpi.

Subsequently, an image pattern is detected at Step 209. In the image pattern detection, which of the three kinds of patterns of "line-drawing/character", "halftone dot part", and "all-pixel printing" corresponds to an image pattern is detected by setting a window length with the number of dots on one line and considering the number of black-and-white changing points and a dot interval after crossing over two changing points in the similar manner as in the first embodiment.

If the "line-drawing/character" pattern is detected, the process proceeds to Step 210 so as to perform a data thinning setting A (no thinning). If the "halftone dot part" pattern is detected, the process proceeds to Step 211 so as to perform a data thinning setting B (thinning of 25%). If the "all-pixel printing" pattern is detected, the process proceeds to Step 212 so as to perform a data thinning setting C (thinning of 50%).

In any case, a thinning rate is set for each predetermined range of image data (in this case, one line) and a dot to be printed is determined out of four dots corresponding to one black pixel at the time of performing double density processing and converting one dot of 600 dpi into four dots of 1,200 dpi.

Subsequently, the process proceeds to Step 213 so as to count the number (Nb) of pixels in each line of the image data after double density processing and thinning. A comparison is made between the number Na of pixels in one line before thinning (1,200 dpi conversion) and the number Nb of pixels in one line after double density processing and thinning (1,200 dpi) at Step 214 in FIG. 9.

If the product of the toner saving rate Sr set at Step 201 and the number Na of pixels is equal to the number Nb of pixels, the process proceeds to Step 215 so as to make the LED elements in the LPH 5 emit light for the light-emitting time set at Step 204.

If the product of the toner saving rate Sr and the number Na of pixels is not equal to the number Nb of pixels, the process proceeds to Step 216 and a light-emitting time Ts is calculated for each line so that a toner saving rate is equal to the toner saving rate Sr set at Step 201.

In addition, the amount ΔT of change in a light-emitting time from the previous line is calculated at Step 217.

A comparison is made at Step 218 between the upper limit value ΔTmax of the amount of change in a light-emitting time between lines set at Step 203 and the amount ΔT of change in a light-emitting time from the previous line calculated at Step 217.

If ΔTmax is equal to or smaller than ΔT, a light-emitting time Tx is calculated from the upper limit value ΔTmax of the amount of change at Step 219. A comparison is made at Step 220 between the light-emitting time lower limit value Tmin set at Step 202 and the light-emitting time Tx calculated at Step 219.

If Tmin is equal to or larger than Tx, the process proceeds to Step 223 and the LED elements in the LPH 5 are made to emit light with the light-emitting time lower limit value Tmin set at Step 202. If Tmin is smaller than Tx, the process proceeds to Step 224 and the LED elements in the LPH 5 are made to emit light for the light-emitting time Tx calculated at Step 219.

If ΔTmax is larger than ΔT in the comparison at Step 218, a comparison is made at Step 221 between the light-emitting time Ts calculated at Step 216 and the light-emitting time lower limit value Tmin set at Step 202.

If Tmin is equal to or smaller than Ts, the process proceeds to Step 222 and the LED elements in the LPH 5 are made to emit light for the light-emitting time Ts calculated at Step 216.

If Tmin is larger than Ts, the process proceeds to Step 223 and the LED elements in the LPH 5 are made to emit light with the light-emitting time lower limit value Tmin set at Step 202.

If the light emission ends at any of Steps 215, 222, 223, and 224, it is determined whether the processing on all lines ends at Step 225. If not, the process returns to Step 206 in FIG. 8 so as to repeat the processing of each step described above on the next line. If the processing on all lines is determined to end at Step 225, the processing in FIGS. 8 and 9 ends.

According to the second embodiment, setting the lower limit value of a light-emitting time can prevent an image from being excessively faded and an image that seems to be decolored in a stripe shape from being formed.

Setting the upper limit value of the amount of change in a light-emitting time between lines can reduce a large difference in a light-emitting time from the previous line. Therefore, a change in print density is reduced so as to prevent an image that seems to be decolored in a stripe shape from being formed.

A light-emitting time appropriate for a target image is obtained by comparing the lower limit value Tmin of a light-emitting time, the light-emitting time Tx calculated from the upper limit value ΔTmax of the amount of change in a light-emitting time between lines, and the light-emitting time Ts calculated so that a toner saving rate is equal to the set toner saving rate Sr. This processing can satisfy the toner saving rate and form an image having less deterioration.

In each of the embodiments, a pattern of image data is detected using the number of black-and white changing points, but an image pattern may be detected using, for example, a matrix pattern of n by n.

The processing of the flowcharts illustrated in FIG. 7 or FIGS. 8 and 9 includes each procedure of the optical writing control method for writing an image on a photoconductor with light emitted from a light-emitting element array including a plurality of light-emitting elements lined in one direction.

In other words, the processing includes a thinning procedure for thinning pixels in input binary image data depending on a pattern of the image data and a thinning rate setting procedure for setting the thinning rate for each predetermined range of the image data. The processing also includes a light-emitting time changing procedure for changing the light-emitting time of a light-emitting element array for each predetermined range of the binary image data thinned in the thinning procedure depending on the thinning rate set in the thinning rate setting procedure and the set toner saving rate.

The processing of these flowcharts corresponds to a computer program for causing a computer in a device that writes an image on a photoconductor with light emitted from a light-emitting element array including a plurality of light-emitting elements lined in one direction to execute each step of the procedure.

A description will be made of a print dot setting for three-time and four-time density with reference to FIGS. 10 and 11.

Figure 10:
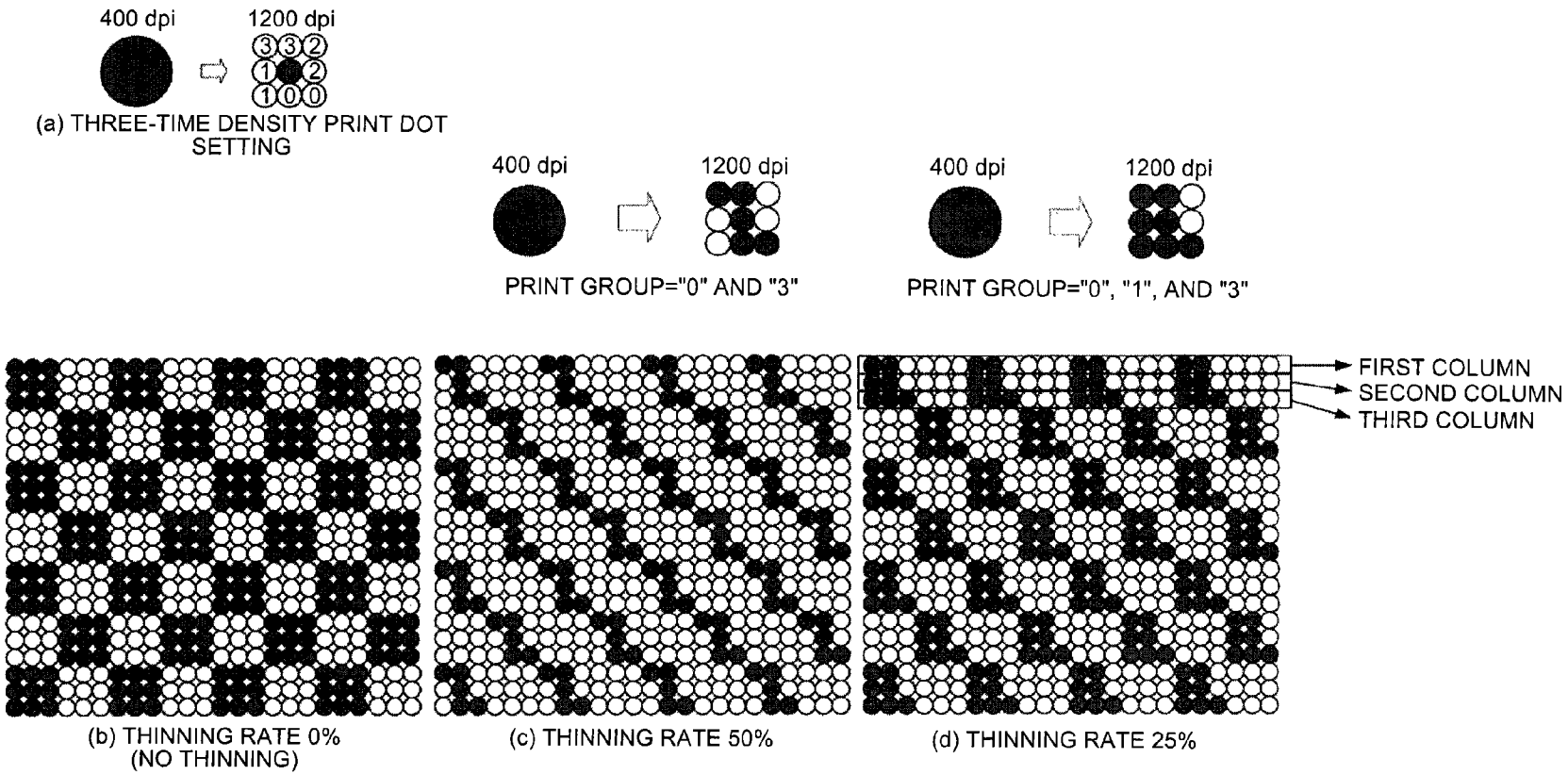
FIG. 10 is a diagram illustrating an example of image patterns due to different thinning rates in three-time density conversion.
Figure 11:
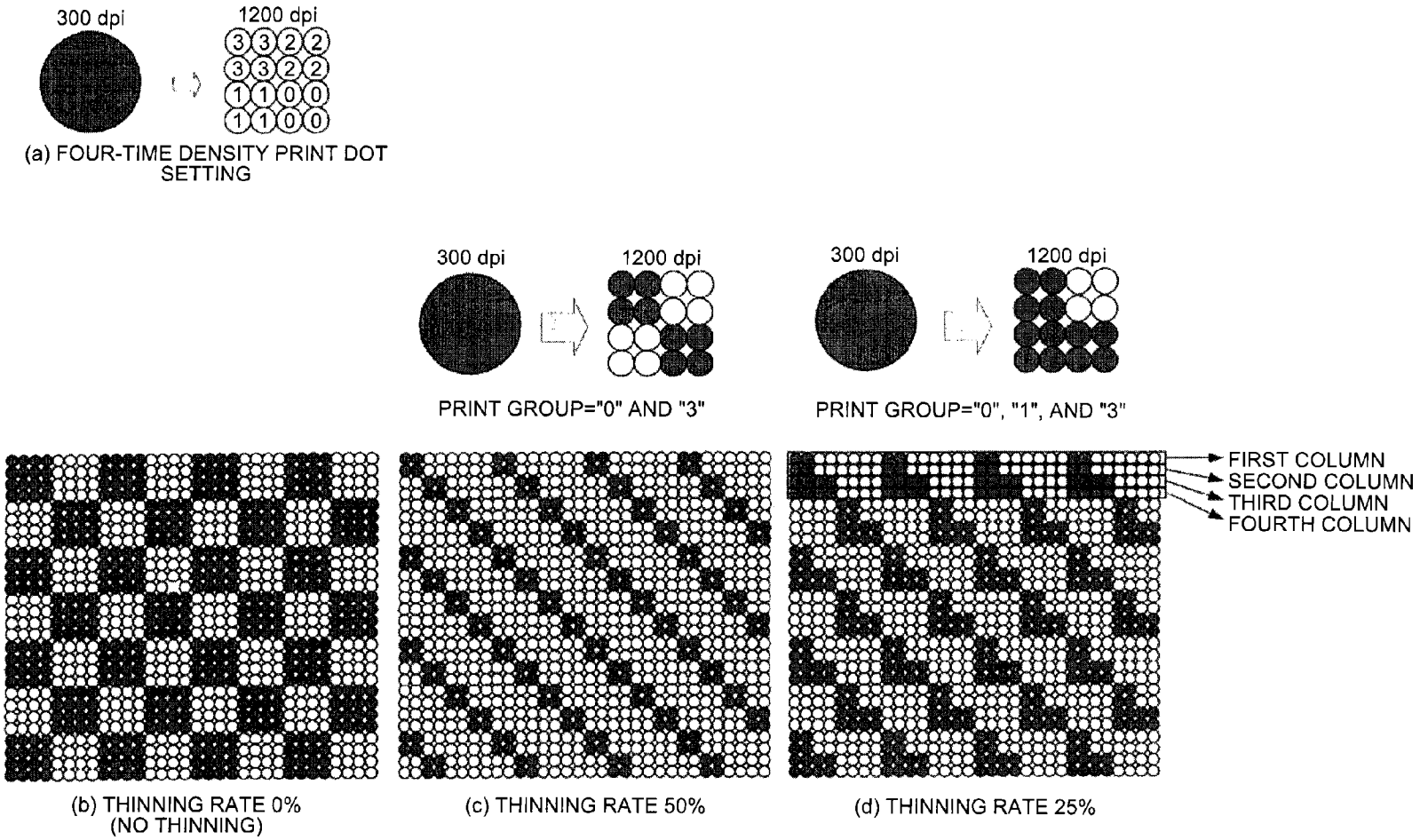
FIG. 11 is a diagram illustrating an example of image patterns due to different thinning rates in four-time density conversion.

FIG. 10 illustrates an example of a case where a three-time density print dot setting is performed from 400 dpi to 1,200 dpi and FIG. 11 illustrates an example of a case where a four-time density print dot setting is performed from 300 dpi to 1,200 dpi.

The sections (b), (c), and (d) in FIGS. 10 and 11 illustrate the print dot patterns of image data after density conversion when the thinning rate is 0% (no thinning), when the thinning rate is 50%, and when the thinning rate is 25%, respectively.

In these embodiments, print dots after density conversion are set by dividing them into four groups of 0 to 3. The numbers described in the circles at dots constituting a pixel converted into 1,200 dpi in the sections (a) in FIGS. 10 and 11 correspond to the groups of 0 to 3.

For example, in the thinning rate of 50% illustrated in the sections (c) of FIGS. 10 and 11, two groups of "0" and "3" out of the four groups are set to be printed. Similarly, in the thinning rate of 25% illustrated in the sections (d), three groups of "0", "1", and "3" are set to be printed.

In this case, the toner saving unit 514 in the writing control circuit 502 illustrated in FIG. 3 preliminarily sets a group to be printed for each detected image pattern depending on the toner saving rate, and converts print data depending on the setting. In this embodiment, printing is set by the divided four groups of 0, 1, 2, and 3, but the combination of groups and the number of groups may be changed.

The sections (a) in FIG. 10 and FIG. 11 illustrate print dot patterns of image data on which simple three-time density conversion and four-time density conversion are performed.

If data is thinned so that only the printing rate is defined as 50% as illustrated in the sections (c) of FIGS. 10 and 11, an image similar to hatching may be formed. In the control according to the present invention, when a halftone dot part is detected from the detection of an image pattern, the thinning pattern such as the one in the sections (d) is set. The light-emitting time is controlled for each line so as to prevent formation of an image similar to hatching and achieve the toner saving rate of 50%.

The light-emitting time is obtained from the section (d) in FIG. 10.

The first and second columns have eight pixels out of twelve pixels printed in 1,200 dpi conversion, and the thinning rate is 33.3% and the printing rate is 67%. In order to achieve the toner saving rate of 50%, "50%/Printing rate 67%=Light-emitting time 75%" is required. Accordingly, the light-emitting time is set to 75%.

The third column has twelve pixels out of twelve pixels printed in 1,200 dpi conversion, and the thinning rate is 0% and the printing rate is 100%. In order to achieve the toner saving rate of 50%, "50%/Printing rate 100%=Light-emitting time 50%" is required. Accordingly, the light-emitting time is set to 50%.

Next, the light-emitting time is obtained from the section (d) in FIG. 11.

The first and second columns have eight pixels out of sixteen pixels printed in 1,200 dpi conversion, and the thinning rate is 50% that is equal to the toner saving rate. Thus, the light-emitting time remains at the default.

The third and fourth columns have sixteen pixels out of sixteen pixels printed in 1,200 dpi conversion, and the thinning rate is 0% and the printing rate is 100%. In order to achieve the toner saving rate of 50%, "50%/Printing rate 100%=Light-emitting time 50%" is required. Accordingly, the light-emitting time is set to 50%.

Each of the embodiments describes an example of the present invention applied when image data is converted with density from low resolution to high resolution and print dots are thinned, but this is not essential and the present invention can be similarly applied to the case where the density of an image data is not converted and print dots are thinned.

The example has been described of detecting a pattern of an image and calculating a light-emitting time for each line as a predetermined range of image data, but the predetermined range is not limited to one line and may be multiple lines.

The embodiments according to the present invention describe an example of a light-emitting element array constructed by connecting three LPHs in a zigzag form, but the number and the kind of LPHs to be used may be changed as appropriate. For example, the number of LPHs to be used may be changed depending on the maximum writing width.

In the configuration where a connection point is between light-emitting element arrays, if the toner saving is performed using only the LPH light-emitting time control in the conventional technique, density unevenness may occur between LPHs. However, according to the present invention, density unevenness between the LPHs can be reduced because the thinning rate and the light-emitting time are changed for each predetermined range of image data.

The computer program illustrated in the flowcharts in FIG. 7 or FIGS. 8 and 9 may be configured to be preliminarily stored in a memory of a microcomputer in the system control circuit 201 or the writing control circuit 502 in the image forming device illustrated in FIG. 1 and to be read and operated by a central processing unit (CPU).

The computer program stored in a recording medium may be read by a built-in computer, and the computer program may be downloaded from the outside to be used if the image forming device is connected to a network.

The image forming device according to the present invention includes the optical writing device according to the present invention, but examples of the image forming device may definitely include not only a copier but also a printer, a facsimile, and a multifunction peripheral having these functions. The present invention is also applicable to a case when image data received from the outside and image data read from a recording medium, as well as image data obtained by reading a document, are printed in a toner saving mode.

The embodiments according to the present invention have been described, but specific configurations and contents of processing and the like of each of the units in the embodiments are not limited to those described above.

Of course, the present invention is not limited to the above-mentioned embodiments and is not limited at all except that the present invention includes technical features described in each claim in the appended claims.

Furthermore, configuration examples, operation examples, variation examples, and the like according to the embodiments described above may be modified or added as appropriate, a part of them may be deleted, and they may be optionally combined to be implemented as far as they are not inconsistent with each other.

An embodiment can prevent image quality from being deteriorated and reduce output of an unintended hatching image even when image data is thinned and written.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing device that writes an image on a photoconductor with light emitted from a light-emitting element array including a plurality of light-emitting elements lined in one direction, the optical writing device comprising:

circuitry configured to:

set a corresponding thinning rate for a corresponding predetermined range of image data based on a pattern in the corresponding predetermined range of the image data;

thin pixels in the corresponding predetermined range of the image data based on the corresponding thinning rate; and change a light-emitting time of the light-emitting element array for the corresponding predetermined range of the image data that has been thinned when a corresponding printing rate does not equal a previously set toner saving rate, wherein the corresponding printing rate equals (1−the corresponding thinning rate).

2. The optical writing device according to claim 1, wherein the circuitry is configured to:

perform density conversion on the corresponding predetermined range of the image data, set the corresponding thinning rate for the corresponding predetermined range of the image data after the density conversion, and thin the pixels in the corresponding predetermined range of the image data after the density conversion.

3. The optical writing device according to claim 1, wherein the corresponding predetermined range of the image data is one line.

4. The optical writing device according to claim 1, wherein the circuitry is configured to detect the pattern of the corresponding predetermined range of the image data, and set different thinning rates depending on a kind of the detected pattern.

5. The optical writing device according to claim 4, wherein the circuitry is configured to detect a number of black-and-white changes in the corresponding predetermined range of the image data in a set window length so as to detect the pattern of the corresponding predetermined range of the image data.

6. The optical writing device according to claim 5, wherein the circuitry is configured to change a setting of the window length.

7. The optical writing device according to claim 5, wherein the number of black-and-white changes in the corresponding predetermined range of the image data corresponds to a number of changing points from black to white or from white to black in the corresponding predetermined range of the image data, and the circuitry is configured to set the corresponding thinning rate for the corresponding predetermined range of the image data based on the number of changing points.

8. The optical writing device according to claim 1, wherein the circuitry is configured to determine a lower limit value for the light-emitting time.

9. The optical writing device according to claim 1, wherein the circuitry is configured to determine an upper limit value for an amount of change in the light-emitting time in each line.

10. An image forming device comprising the optical writing device according to claim 1.

11. The optical writing device according to claim 1, wherein the corresponding printing rate corresponds to a ratio between a first number of pixels in the corresponding predetermined range of the image data after thinning and a second number of pixels in the corresponding predetermined range of the image data before thinning.

12. The optical writing device according to claim 1, wherein the light-emitting time corresponds to a ratio between the toner saving rate and the corresponding printing rate.

13. An optical writing control method of writing an image on a photoconductor with light emitted from a light-emitting element array including a plurality of light-emitting elements lined in one direction, the optical writing control method comprising:

setting a corresponding thinning rate for a corresponding predetermined range of image data based on a pattern in the corresponding predetermined range of the image data;

thinning pixels in the corresponding predetermined range of the image data based on the corresponding thinning rate; and changing a light-emitting time of the light-emitting element array for the corresponding predetermined range of the image data that has been thinned when a corresponding printing rate does not equal a previously set toner saving rate, wherein the corresponding printing rate equals (1−the corresponding thinning rate).

14. A computer program product comprising a non-transitory computer-readable medium containing an information processing program, the program causing a computer in a device that writes an image on a photoconductor with light emitted from a light-emitting element array including a plurality of light-emitting elements lined in one direction, to perform:

setting a corresponding thinning rate for a corresponding predetermined range of image data based on a pattern in the corresponding predetermined range of the image data;

thinning pixels in the corresponding predetermined range of the image data based on the corresponding thinning rate; and changing a light-emitting time of the light-emitting element array for the corresponding predetermined range of the binary image data that has been thinned when a corresponding printing rate does not equal a previously set toner saving rate, wherein the corresponding printing rate equals (1−the corresponding thinning rate).

* * * * *